US007592548B2

(12) United States Patent
Marszalek et al.

(10) Patent No.: US 7,592,548 B2
(45) Date of Patent: Sep. 22, 2009

(54) SECURITY CABLE, A METHOD FOR MAKING THE SAME AND A METHOD FOR SECURING AN ELECTRONIC DEVICE

(75) Inventors: Christopher Marszalek, Plainfield, IL (US); Daniel Horvath, Marseilles, IL (US); Salim F. Audish, Northridge, CA (US)

(73) Assignee: Sennco Solutions, Inc, Planfield, IL (US)

( * ) Notice: Subject to any disclaimer, the term of this patent is extended or adjusted under 35 U.S.C. 154(b) by 0 days.

(21) Appl. No.: 11/702,964

(22) Filed: Feb. 6, 2007

(65) Prior Publication Data

US 2007/0169956 A1 Jul. 26, 2007

Related U.S. Application Data

(63) Continuation of application No. 10/852,901, filed on May 25, 2004, now Pat. No. 7,202,417.

(51) Int. Cl.
*H01B 11/02* (2006.01)

(52) U.S. Cl. ..... 174/113 R

(58) Field of Classification Search ..... 174/103, 174/113 R, 108

See application file for complete search history.

(56) References Cited

U.S. PATENT DOCUMENTS 2,950,338 A * 8/1960 Taylor ..... 174/40 R
3,676,576 A * 7/1972 Dubernet et al. ..... 174/113 R
5,315,063 A * 5/1994 Auclair ..... 174/78

* cited by examiner

*Primary Examiner*—Chau N Nguyen
(74) *Attorney, Agent, or Firm*—Patents+TMS, P.C.

(57) ABSTRACT

A security cable for electrically connecting an electrical device, such as, for example, a digital camera, a cam-corder, digital audio player, or like device are provided. Also provided is a method for making the security cable and a method for securing the electrical device using the security cable. A housing, or tubing, may be provided which may have one or more electrical wires. Preferably, the security cable may have six signal-transmitting wires, each of which may transmit a different type of signal. The signal-transmitting wires may be wound around a metal cord within the housing in a spiral manner. The metal cord may have a tensile strength which may prevent cutting of the security cable by conventional tools, and may, therefore, prevent theft of the electrical device from a display area.

7 Claims, 2 Drawing Sheets

SECURITY CABLE, A METHOD FOR MAKING THE SAME AND A METHOD FOR SECURING AN ELECTRONIC DEVICE

This application is a Continuation Application of U.S. patent application Ser. No. 10/852,901 filed on May 25, 2004 now U.S. Pat. No. 7,202,417.

BACKGROUND OF THE INVENTION

The present invention generally relates to a security cable which may connect an electrical device, such as, for example, a digital camera, digital camcorder, digital audio player, or the like, to a power supply system and may prevent theft of the electrical device. The present invention also relates to a method for making the same. The security cable may have a housing having one or more signal transmitting wires which may connect the electrical device to a power supply system, or network, for example. Also within the housing of the cable may be a metal cord which may have a tensile strength which may prevent cutting of the security cable.

It is generally known to display electrical devices, for example, in a store or other venue. Large electronics retailers, such as, for example, Best Buy or Circuit City, have a display area in which the electrical devices are presented. The electrical devices are connected to a network which provides several functions. For example, the network has a power source which provides voltage and/or current for the electrical device. The network also has components which transmit and/or receive signals corresponding to video images and/or audio signals captured by the electrical device. Further, the network has an alarm center which provides an anti-theft function by monitoring a position of the electrical device within a display area. The connection to the network is provided via signal transmitting wires connected to the electrical device as well as other components in the network, such as, for example, circuit boards.

It is also known to display clothing in a store or other venue. An anti-theft system is typically used with expensive clothing, such as, for example, jackets, coats, formalwear, or the like. The anti-theft system includes one or more wires which monitor a presence of a sensor attached to the clothing. Removal of the sensor activates an alarm to notify store management and/or security that an article of clothing is being stolen.

Often the electrical devices or clothing are the subject of theft by, for example, individuals cutting wires which connect the electrical device or the clothing to the network. A potential solution to this problem is the connecting of the electrical device or the clothing to a metal wire which may withstand a force from a conventional cutting tool. However, connection of a metal wire, in addition to connection of signal-transmitting wires, to the electrical device or the clothing is a labor-intensive and/or time-consuming task.

Another potential solution is the inclusion of a metal cord within a housing which has the signal-transmitting wires. However, the inclusion of a metal cord with signal-transmitting wires causes electric and/or magnetic interferences which prevent the signal-transmitting wires from performing a desired function. Further, the signal transmitting wires often become damaged in structure when the housing is pulled, or bent, as in when, for example, the electrical device or the clothing is removed from the display area for a demonstration or wear by a customer.

A need, therefore, exists for a security cable which may connect to a network and may prevent theft of the electrical device or the clothing wherein the security cable may have signal transmitting wires intertwined with a metal cord without any presence of interferences.

SUMMARY OF THE INVENTION

The present invention generally relates to a security cable for electrically connecting an electrical device, such as, for example, a digital camera, a camcorder, digital audio player, or other electrical device. The security cable may have a housing which may have one or more signal-transmitting wires. In a preferred embodiment, the security cable has six signal-transmitting wires which may perform a variety of functions. The signal-transmitting wires may be intertwined with a metal cord within the housing. More specifically, the signal-transmitting wires may be wound around the metal cord in a spiral manner along a length of the metal cord. In another embodiment, the security cable may be implemented in a system to secure, for example, clothing in a store or other venue.

To this end, in an embodiment of the present invention, a security cable is provided. The security cable has a cylindrical housing having a length defined between a first end and a second end. The security cable also has a plurality of wires within the housing wherein each of the plurality of wires conducts a signal. In addition, the security cable has a metal cord within the housing wherein the metal cord has a length which extends substantially parallel to the length of the housing wherein each of the plurality of wires are wrapped around the metal cord along the length of the metal cord.

In an embodiment, one of the plurality of wires transmits a first signal and a second wire of the plurality of wires transmits a second signal wherein the first signal and the second signal are different.

In an embodiment, the plurality of wires includes six wires.

In an embodiment, the security cable has a fastening device attached to the metal cord.

In an embodiment, each of the plurality of wires is distinctly colored from another one of the plurality of wires.

In another embodiment of the present invention, a security cable is provided. The security cable has a plurality of wires wherein each of the plurality of wires is encased within an insulating material and further wherein a first wire in the plurality of wires transmits a first signal and a second wire in the plurality of wires transmits a second signal. The security cable also has a metal cord having a length defined between a first end and a second end wherein each of the plurality of wires is wound around the length of the metal cord.

In an embodiment, the security cable has a housing which contains each of the plurality of wires.

In an embodiment, the metal cord has a tensile strength of at least 400 pounds.

In an embodiment, the first signal and the second signal are different types of signals.

In an embodiment, each of the plurality of wires is wound around the metal cord in a spiral formation.

In an embodiment, the security cable has a fastener having a female portion wherein the fastener is attached to the metal cord.

In an embodiment, the insulating material for each of the plurality of wires is distinctly colored.

In another embodiment of the present invention, a method is provided for making a security cable. The method has the steps of providing a metal cord having a length defined between a first end and a second end; and wrapping a plurality of wires around the length of the metal cord wherein each wire is wrapped along the length of the metal cord in a spiral manner and wherein the wires transmit at least two different types of signals.

In an embodiment, the method has the further step of encasing the wires within a tubing.

In an embodiment, the method has the further step of providing a fastener extending from the first end of the metal cord.

In an embodiment, the method has the further step of assigning a different color to each one of the plurality of wires.

In another embodiment of the present invention, a method is provided for securing an electrical device having a plurality of inputs which receive a signal. The method has the steps of providing a cable having a signal transmitting wire wound around a metal cord having a length wherein the signal transmitting wire is wound around the metal cord in a spiral manner along the length; connecting one of the plurality of inputs of the electrical device to one of the plurality of wires; and connecting the metal cord to the electrical device.

In an embodiment, the method has the further step of attaching a fastener to the metal cord prior to connecting the metal cord to the electrical device.

In an embodiment, the method has the further step of connecting the signal transmitting wire to a micro-controller.

In an embodiment, the method has the further step of transmitting signals to the electrical device through the signal transmitting wire.

It is, therefore, an advantage of the present invention to provide a security cable, a method for making the same and a method for securing an electrical device wherein the cable may have a metal cord which may withstand a force from a cutting tool and may, therefore, prevent theft of an electrical device.

Another advantage of the present invention is to provide a security cable, a method for making the same and a method for securing an electrical device wherein the security cable may have signal-transmitting wires and a metal cord within a single housing and may, therefore, reduce an amount of space required for securing an electrical device.

Yet another advantage of the present invention is to provide a security cable, a method for making the same and a method for securing an electrical device wherein signal-transmitting wires may be encased within a housing having a metal cord and wherein the signal-transmitting wires are intertwined with the metal cord in a manner wherein no electrical and/or magnetic and/or other type of interference is present in the security cable.

Moreover, an advantage of the present invention is to provide a security cable, a method for making the same and a method for securing an electrical device wherein the security cable may be easy to manufacture.

Further, an advantage of the present invention is to provide a security cable, a method for making the same and a method for securing an electrical device wherein the cable may have one or more signal-transmitting wires which may connect the electrical device to a network.

Still further, an advantage of the present invention is to provide a security cable, a method for making the same and a method for securing an electrical device wherein the security cable may be inexpensive to manufacture.

And, an advantage of the present invention is to provide a security cable, a method for making the same and a method for securing an article of clothing wherein the security cable may prevent theft of the article of clothing.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a security cable which may connect an electrical device to a network. The security cable may have a housing which may have one or more signal-transmitting wires. A metal cord having a tensile strength which may resist a force from a cutting tool may be within the housing along a length of the housing. The signal-transmitting wires may be wound around the metal cord in a spiral manner along a length of the metal cord. In an alternate embodiment, the security cable may be implemented within a system to prevent theft of an article of clothing.

Figure 1:
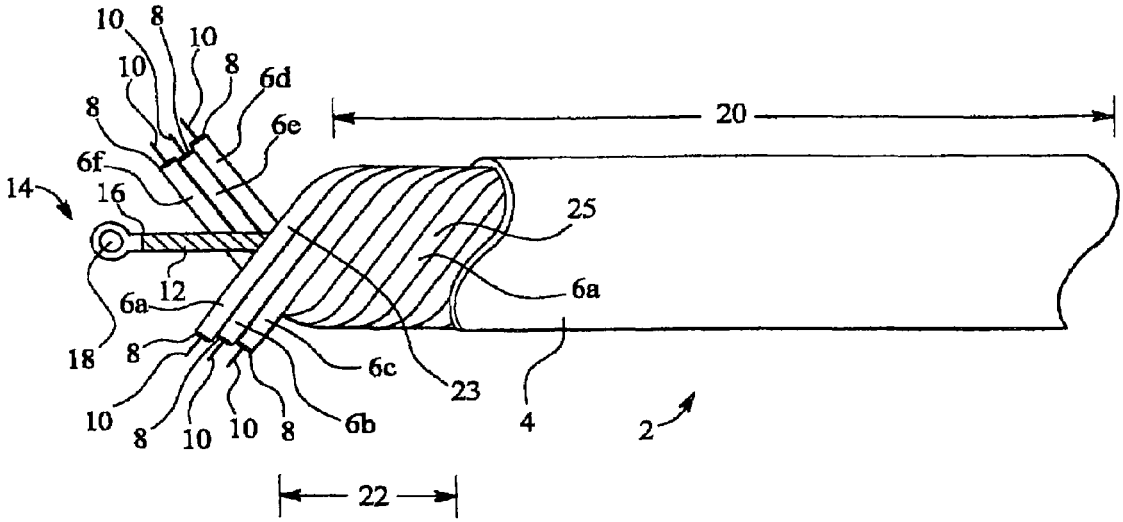
FIG. 1 illustrates a perspective view of a section of a cable in an embodiment of the present invention.

Referring now to the drawings wherein like numerals refer to like parts, FIG. 1 illustrates a cable 2 having a housing 4 which may encase one or more signal-transmitting wires, for example, the wires 6A though 6F. The housing 4 may be constructed from, for example, rubber, plastic, or like material. The signals which may be transmitted by the wires 6A through 6F may be, for example, electrical signals, such as signals capable of transmitting a current or a voltage. The signals may also be, for example, analog signals or digital signals that may transmit video signals and/or audio signals. In an embodiment, the signals may be communication signals, such as, for example, those within an alarm system, or between a power source and a micro-controller. Each of the wires 6A through 6F may simultaneously transmit a different type of signal. In addition, each of the wires 6A through 6F may have an insulating material 8 which may surround a core 10 which may be constructed from, for example, metal, silicon, or other conductive material. In an embodiment, the insulating material 8 for each of the wires 6A through 6F may be distinctly colored to provide a color code for the wires 6A through 6F. A color, such as yellow, may designate that a wire transmits, for example, a video signal. A color, such as black, may designate that a wire transmits, for example, a voltage signal.

The housing 4 may also encase a metal cord 12 which may be constructed from, for example, galvanized steel or other metal. Moreover, the metal cord 12 may have a tensile strength which may prevent cutting of the security cable 2 by conventional cutting tools. In a preferred embodiment, the tensile strength of the metal cord 12 may be greater than or equal to 480 pounds. In other embodiments, the tensile strength may range from 400 pounds to 500 pounds. Moreover, any tensile strength suitable for securing an electrical device from theft may be used for the security cable 2. A fastener 14 may be attached at a first end 16 of the metal cord 12. The fastener 14 may have a female portion 18 for receiving, for example, a screw or other type of male fastener (not shown). In an embodiment, the fastener 14 may have a male portion (not shown).

The metal cord 12 may extend along a length 20 of the security cable 2. Further, the signal transmitting wires 6A through 6F may also extend along the length 20 of the security cable 2. Each of the signal transmitting wires 6A through 6F may be wrapped around the metal cord 12 in a spiral manner. As a result, in a preferred embodiment, a spacing 22 between a point 23 on the signal transmitting wire 6A and a point 25 on the signal transmitting wire 6A directly along the length 20 of the security cable 2 may be approximately three inches. Other spacings which may provided between the points 23, 25 may be in a range of 1.50 inches to 3.50 inches.

Figure 2:
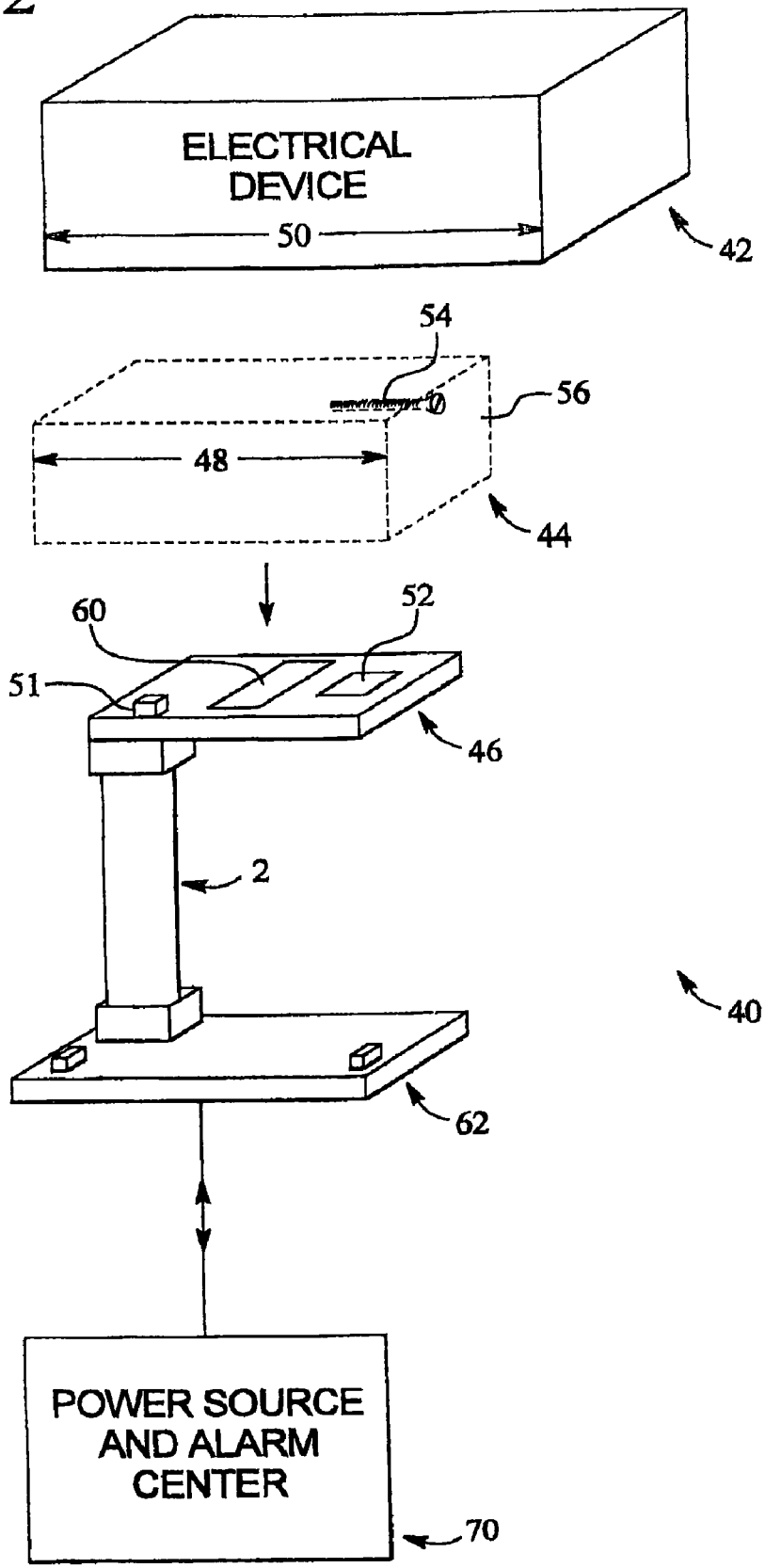
FIG. 2 illustrates a diagram of a system incorporating the cable of FIG. 1.

FIG. 2 illustrates a system 40 which may incorporate the security cable 2. The system 40 may have an electrical device 42 which may be, for example, a digital camera, digital camcorder, digital audio player, or the like. Connected to the electrical device 42 may be a housing 44 which may encase a sensor circuit board 46. The housing 44 may have a length 48 which may correspond to a length 50 of the electrical device 42.

A sensor 52 may be connected to the sensor circuit board 46 within the housing 44 and may emit, for example, an infrared ray. A fastener 54, such as, for example, a screw may be inserted within a wall 56 of the housing 44. The infrared ray emitted by the sensor 52 may detect a position of the fastener 54 as well as a change in position of the fastener 54. A change in position of the fastener 54 may indicate that the electrical device 42 is an object of tampering or theft. A light-emitting diode 51 may be connected to the sensor circuit board 46 and may be activated during a change of position of the fastener 54 as an alarm function.

The sensor circuit board 46 may also have a micro-controller 60 which may transmit signals via the security cable 2 to a power supply circuit board 62. For example, the micro-controller 60 may transmit a signal to the power supply circuit board 62. The signal may communicate to the power supply circuit board 62 an amount of voltage required to power the electrical device 42. The power supply circuit board 62 may then transmit the required amount of voltage to the electrical device 42. The security cable 2 may be connected to the sensor circuit board 46 and the power supply circuit board 62 via a male connector (not shown) and a female connector (not shown). More specifically, the male connector may be associated with the security cable 2 and the female connector may be associated with the sensor circuit board 46 and/or the power supply circuit board 62. In a preferred embodiment, the male connector and the female connector may be, for example, Molex™ connectors.

Moreover, the signal transmitting wires 6A through 6F may each serve a different function within the system 40. For example, the signal transmitting wire 6A may transmit a video image from the electrical device 42 to the power supply circuit board 62. The signal transmitting wire 6B may transmit a video signal from the power supply circuit board 62 to the electrical device 42. The signal transmitting wires 6C and 6D may transmit and/or may receive voltage between the power supply circuit board 62 and the electrical device 42. The signal transmitting wire 6E may provide communication between the micro-controller 60 and the power supply circuit board 62 wherein a voltage is communicated to the power supply circuit board 62. The signal transmitting wire 6F may communicate an alarm status for the system 40. For example, if the fastener 54 is removed or a position of the fastener 54 is changed, the micro-controller 60 may communicate the change in position to the power supply circuit board 62 via the signal transmitting wire 6F.

The power supply circuit board 62 may be connected to a combined power source and alarm center 70. Power may be supplied to the electrical device 42 as well as any other electrical device which may be present in the system 40. The combined power source and alarm center 70 may also monitor tampering or theft of the electrical device 42 via the sensor 52.

Winding of the signal transmitting wires 6A through 6F around the metal cord 12 may enable the wires 6A through 6F to transmit and/or to receive signals without any types of interferences, such as, for example, electrical, magnetic, and/or other type of interference. When the electrical device 42 is removed from a display area for a demonstration by a customer, the security cable 2 may be bent and/or pulled or may receive a stress. Winding of the signal transmitting wires 6A through 6F in a spiral manner may enable the wires 6A through 6F to absorb the stress. As a result, the wires 6A through 6F may be bent or otherwise manipulated without damage to the wires 6A through 6F. Accordingly, in another embodiment, the security cable 2 may be implemented in, for example, an electronic network for monitoring and/or securing an article of clothing.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A security cable to electrically connect and to mechanically secure an article to prevent theft of the article from a display area, the security cable comprising:

a plurality of wires to electrically connect the article wherein each wire has a core wherein the core is separately encased within an insulating material without connection to any other wire of the plurality of wires wherein the core has a diameter and the insulating material has a thickness wherein the thickness of the insulating material is greater than the diameter of the core and further wherein a first wire in the plurality of wires transmits a first signal and a second wire in the plurality of wires transmits a second signal;

a metal cord to mechanically secure the article wherein the metal cord has a length defined between a first end and a second end wherein the metal cord has a tensile strength of at least 400 pounds wherein each of the plurality of wires is independently wound around the length of the metal cord at a pitch that is angularly oriented with respect to the length of metal cord without electrical connection between the metal cord and the plurality of wires;

a housing having a length defined between a first end and a second end wherein the housing has walls enclosing an interior of the housing wherein each wire and the metal cord extend within the interior of the housing from the first end of the housing to the second end of the housing wherein each wire is located between the metal cord and the housing wherein the housing is made of a nonconductive material wherein the nonconductive material of the housing is adjacent to the insulating material of each wire; and a fastener connected to the first end of the metal cord to mechanically secure the article wherein the fastener extends from the first end of the metal cord.

2. The security cable of claim 1 wherein the metal cord is constructed from galvanized steel.

3. The security cable of claim 1 wherein the first signal and the second signal are electrical signals.

4. The security cable of claim 1 wherein the core is constructed from a conductive material.

5. The security cable of claim 1 wherein the fastener has a female portion wherein the fastener is attached to the metal cord.

6. The security cable of claim 1 wherein the insulating material for each wire is distinctly colored.

7. A security cable comprising:

a plurality of wires wherein each wire has a core wherein the core is separately encased within an insulating material without connection to any other wire of the plurality of wires wherein the core has a diameter and the insulating material has a thickness wherein the thickness of the insulating material is greater than the diameter of the core and further wherein a first wire in the plurality of wires transmits a first signal and a second wire in the plurality of wires transmits a second signal;

a metal cord having a length defined between a first end and a second end wherein the metal cord has a tensile strength of at least 400 pounds wherein each of the plurality of wires is independently wound around the length of the metal cord at a pitch that is angularly oriented with respect to the length of metal cord without electrical connection between the metal cord and the plurality of wires;

a housing having a length defined between a first end and a second end wherein the housing has walls enclosing an interior of the housing wherein each wire and the metal cord extend within the interior of the housing from the first end of the housing to the second end of the housing wherein each wire is located between the metal cord and the housing wherein the housing is made of a nonconductive material wherein the nonconductive material of the housing is adjacent to the insulating material of each wire; and a fastener connected to the first end of the metal cord wherein the fastener extends from the first end of the metal cord.

* * * * *